US009700115B2

(12) United States Patent
Pendergrass

(10) Patent No.: US 9,700,115 B2
(45) Date of Patent: Jul. 11, 2017

(54) CRAFT STORAGE DEVICE

(71) Applicant: Colette T. Pendergrass, Long Island City, NY (US)

(72) Inventor: Colette T. Pendergrass, Long Island City, NY (US)

( * ) Notice: Subject to any disclaimer, the term of this patent is extended or adjusted under 35 U.S.C. 154(b) by 76 days.

(21) Appl. No.: 14/920,961

(22) Filed: Oct. 23, 2015

(65) Prior Publication Data

US 2017/0112247 A1 Apr. 27, 2017

(51) Int. Cl.

| | |
|---|---|
| ***A45C 11/04*** | (2006.01) |
| ***A45C 11/24*** | (2006.01) |
| ***A45C 13/00*** | (2006.01) |
| ***A45C 13/02*** | (2006.01) |
| ***A47F 7/02*** | (2006.01) |
| ***A45C 11/16*** | (2006.01) |

(52) U.S. Cl.

CPC ..... *A45C 11/24* (2013.01); *A45C 11/16* (2013.01); *A45C 13/005* (2013.01); *A45C 13/02* (2013.01); *A47F 7/02* (2013.01)

(58) Field of Classification Search

CPC ..... A45C 11/24; A45C 13/02; A45C 13/005; A45C 11/16; A47F 7/02

USPC ..... 206/6.1, 564, 566

See application file for complete search history.

(56) References Cited

U.S. PATENT DOCUMENTS 3,666,087 A * 5/1972 Cooper ..... B65D 75/322 206/380
4,120,394 A * 10/1978 Soltes ..... B65D 1/36 206/19
4,129,213 A 12/1978 Fleig
4,784,267 A * 11/1988 Gessler ..... B65D 1/36 206/370
5,366,071 A 11/1994 Laszlo
5,540,324 A * 7/1996 Knapp ..... A45C 11/16 206/348
6,334,530 B1 * 1/2002 Morris ..... A47F 7/02 206/566
D485,067 S 1/2004 Wolf
8,118,168 B2 2/2012 Holloway et al.
8,272,505 B2 9/2012 Melamed
2005/0211138 A1 * 9/2005 Gupta ..... D03D 15/0022 108/43
2005/0274635 A1 12/2005 Hopper
2005/0279745 A1 * 12/2005 Gupta ..... D04D 1/04 220/23.4
2008/0169219 A1 * 7/2008 Gupta ..... B65D 85/58 206/564

(Continued)

*Primary Examiner* — Luan K Bui

(57) ABSTRACT

A craft storage assembly includes a case structured to have a first panel hingedly coupled to a second panel. The case is positionable in an open position and a closed position. The first panel has a plurality of grooves extending downwardly therein to contain an object. The first panel has a plurality of wells extending downwardly therein configured to contain a plurality of objects. Each of a plurality of membranes is coupled to the first panel such that each of the membranes completely covers an associated one of the wells. Each of the membranes is penetrable such that the objects are insertable and removable through each of the membranes. Each of a plurality of tracks is coupled to the second panel. Each of the tracks is aligned with an associated one of the grooves when the case is in the closed position to retain the necklaces in the associated groove.

11 Claims, 4 Drawing Sheets

(56) References Cited

U.S. PATENT DOCUMENTS

2010/0200436 A1* 8/2010 Gupta ..... B65D 81/1075
206/205

* cited by examiner

CRAFT STORAGE DEVICE

BACKGROUND OF THE DISCLOSURE

Field of the Disclosure

The disclosure relates to storage devices and more particularly pertains to a new storage device for storing beads and necklaces separate from one another.

SUMMARY OF THE DISCLOSURE

An embodiment of the disclosure meets the needs presented above by generally comprising a case structured to have a first panel hingedly coupled to a second panel. The case is positionable in an open position and a closed position. The first panel has a plurality of grooves extending downwardly therein to contain an object. The first panel has a plurality of wells extending downwardly therein configured to contain a plurality of objects. Each of a plurality of membranes is coupled to the first panel such that each of the membranes completely covers an associated one of the wells. Each of the membranes is penetrable such that the objects are insertable and removable through each of the membranes. Each of a plurality of tracks is coupled to the second panel. Each of the tracks is aligned with an associated one of the grooves when the case is in the closed position to retain the necklaces in the associated groove.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
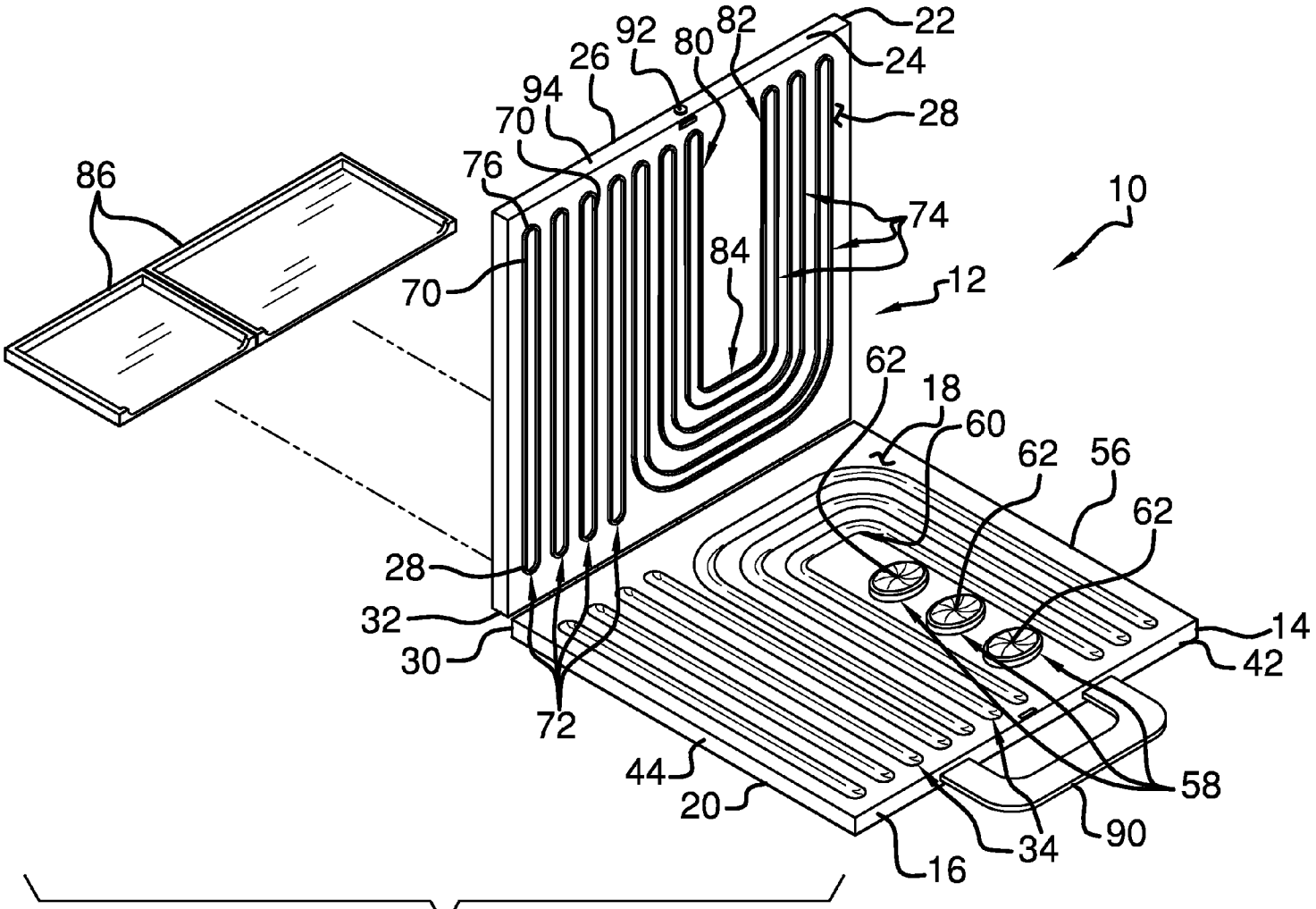
FIG. 1 is a perspective view of a craft storage assembly according to an embodiment of the disclosure.
Figure 2:
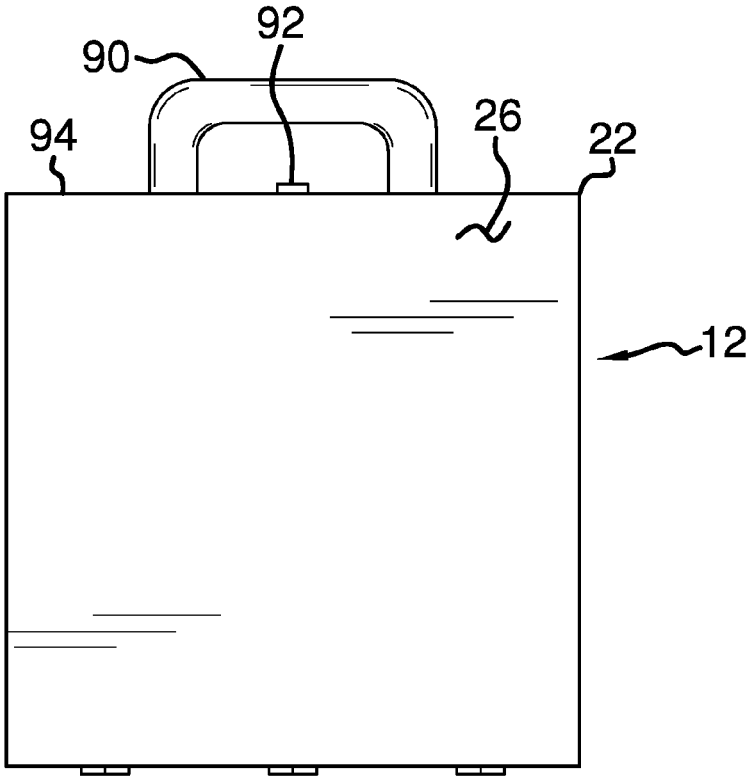
FIG. 2 is a top view of an embodiment of the disclosure in a closed position.
Figure 3:
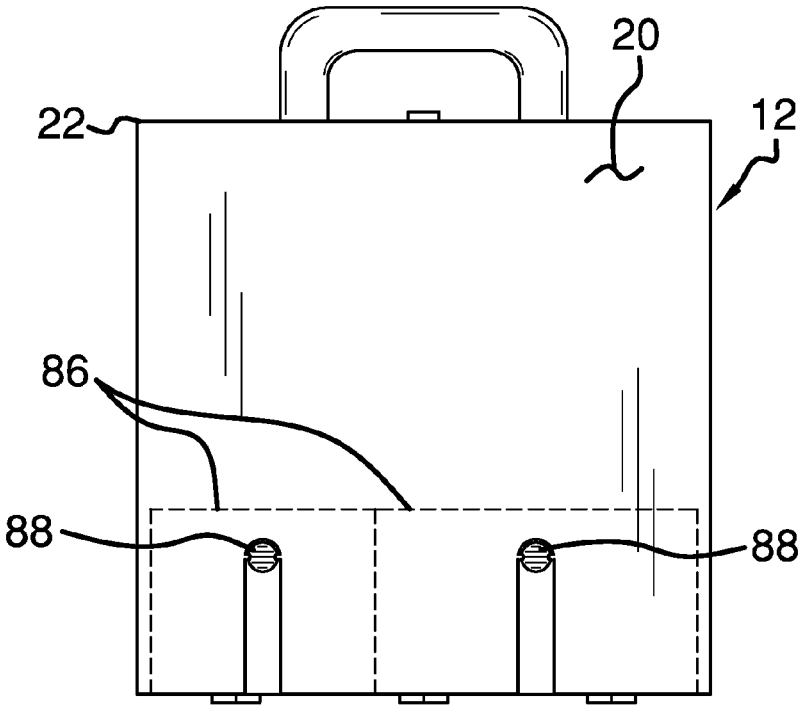
FIG. 3 is a bottom view of an embodiment of the disclosure.
Figure 4:
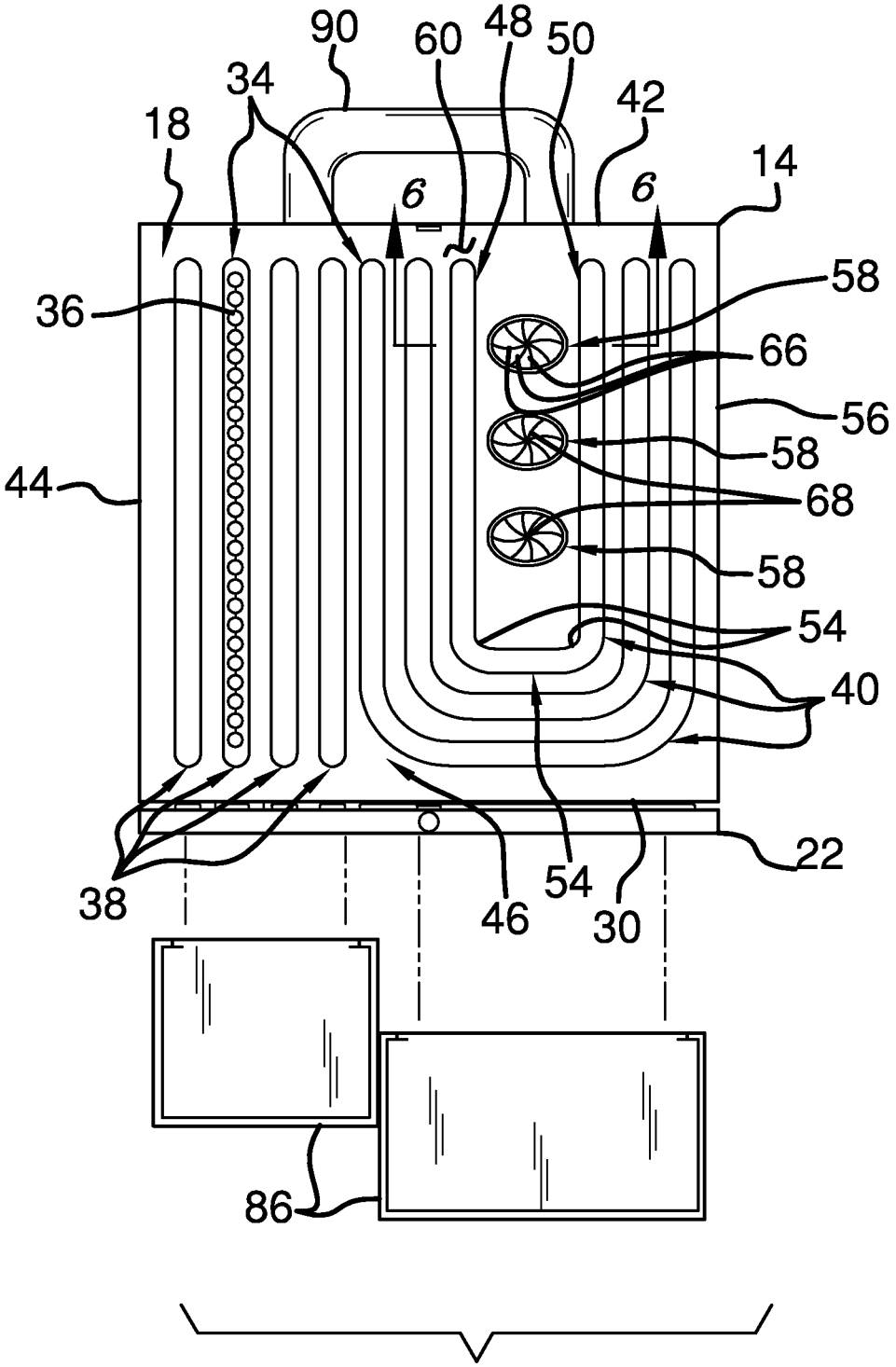
FIG. 4 is a top view of an embodiment of the disclosure in an open position.
Figure 5:
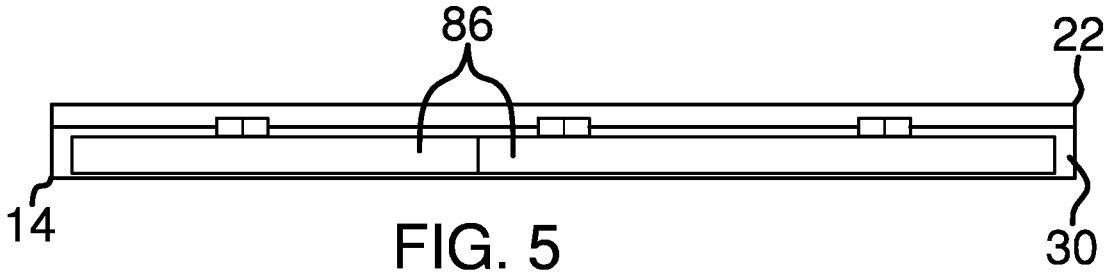
FIG. 5 is a back view of an embodiment of the disclosure.
Figure 6:
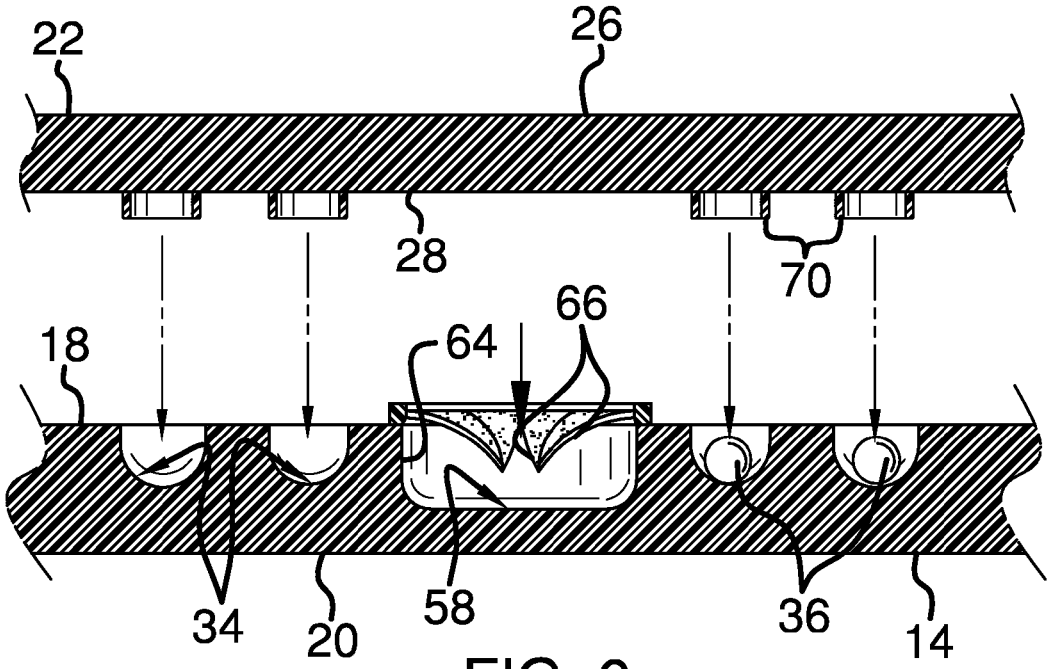
FIG. 6 is a cross sectional view taken along line 6-6 of FIG. 4 of an embodiment of the disclosure.

With reference now to the drawings, and in particular to FIGS. 1 through 6 thereof, a new storage device embodying the principles and concepts of an embodiment of the disclosure and generally designated by the reference numeral 10 will be described.

As best illustrated in FIGS. 1 through 6, the craft storage assembly 10 generally comprises a case 12 structured to be positionable in a closed position and an open position. The case 12 comprises a first panel 14. The first panel 14 has an outer edge 16 extending between a top surface 18 and a bottom surface 20 of the first panel 14. The case 12 further comprises a second panel 22. The second panel 22 has an exterior edge 24 extending between an upper surface 26 and a lower surface 28 of the second panel 22. A back side 30 of the outer edge 16 is hingedly coupled to a rear side 32 of the exterior edge 24 such that the bottom surface 20 abuts the upper surface 26 when the case 12 is positioned in the closed position.

The top surface 18 of the first panel 14 has a plurality of grooves 34 extending downwardly therein to contain a plurality of objects 36. The objects 36 contained in the grooves 34 may be a necklace or the like. The grooves 34 comprise a first set of grooves 38 and a second set of grooves 40. Each of the first set of grooves 38 extends between the back side 30 and a front side 42 of the outer edge 16. The first set of grooves 38 is evenly spaced apart and distributed between a first lateral side 44 of the outer edge 16 and a middle 46 of the first panel 14.

Each of the second set of grooves 40 has a first section 48 and a second section 50 each extending forwardly from an associated one of each end 52 of a rear section 54 such that each of the second set of grooves 40 has a U-shape. Each of the second set of grooves 40 extends between the middle 46 and a second lateral side 56 of the outer edge 16 such that each of the first section 48 and the second section 50 extends between the back side 30 and the front side 42. The second set of grooves 40 is nested with respect to each other.

The top surface 18 of the first panel 14 has a plurality of wells 58 extending downwardly therein to contain a plurality of objects 36. The objects contained in the wells 58 may be beads or the like. The wells 58 are evenly spaced apart and distributed between the rear section 54 of an innermost one 60 of the second set of grooves 40 and the front side 42.

A plurality of membranes 62 is provided. Each of the membranes 62 is coextensively coupled to a bounding edge 64 of an associated one of the wells 58 to completely cover the associated well 58. Each of the membranes 62 has a plurality of cuts 66 radiating outwardly between a center 68 of the membranes 62 and the bounding edge 64. Thus, each of the membranes 62 defines an iris wherein the objects 36 are insertable and removable through each of the membranes 62.

A plurality of tracks 70 is provided. Each of the tracks 70 is coupled to and extends downwardly from the lower surface 28 of the second panel 22. The tracks 70 comprise a first set of the tracks 72 and a second set of the tracks 74. Each of the first set of tracks 72 has a respective first end 76 and a respective second end 78. Each of the first set of tracks 72 is continuous and rounded at each of the first end 76 and the second end 78 such that each of the first set of tracks 72 defines a cigar shape.

Each of the second set of tracks 74 has a respective first section 80, a respective second section 82 and a respective central section 84 such that each of the second set of tracks 74 defines a U-shape. Each of the tracks 70 is aligned with an associated one of the grooves 34 when the case 12 is in the closed position. Additionally, each of the tracks 70 is positioned within the associated groove 34 when the case 12 is in the closed position to retain the objects 36 in the associated groove 34.

A pair of drawers 86 is provided. Each of the drawers 86 is slidably coupled to the back side 30 of the outer edge 16 of the first panel 14. Each of a pair of drawer locks 88 is coupled to an associated one of the drawers 86. Each of the drawer locks 88 engages the case 12 when the respective drawers 86 are positioned in a closed position. Thus, the drawer locks 88 retain the respective drawer 86 in the closed position.

A handle 90 is provided. The handle 90 is curved to define a U-shape. Additionally, the handle 90 is coupled to the front side 42 of the outer edge 16 of the first panel 14. The handle 90 may be gripped to carry the case 12. A case lock 92 is coupled to a forward side 94 of the exterior edge 24 of the second panel 22. The case lock 92 engages the top surface 18 of the first panel 14 when the case 12 is positioned in the closed position, retaining the case 12 in the closed position.

In use, the beads are positioned within each of the wells 58. The necklaces are positioned within a selected one of the grooves 40. Additional items related to the convention of beading may be stored within each of the drawers 86. The case 12 is utilized to keep the beads, necklaces and other item related to the convention of beading organized and separate from one another.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A craft storage assembly comprising:

a case structured to have a first panel hingedly coupled to a second panel wherein said case is positionable in an open position and a closed position;

said first panel having a plurality of grooves extending downwardly therein wherein each of said grooves is configured to contain an object;

said first panel having a plurality of wells extending downwardly therein wherein each of said wells is configured to contain a plurality of objects;

a plurality of membranes, each of said membranes being coupled to said first panel such that each of said membranes completely covers an associated one of said wells, each of said membranes being penetrable such that the objects are insertable and removable through each of said membranes; and a plurality of tracks, each of said tracks being coupled to said second panel, each of said tracks being aligned with an associated one of said grooves when said case is in said closed position wherein each of said tracks is configured to retain the object in said associated groove.

2. The assembly according to claim 1, wherein said first panel having an outer edge extending between a top surface and a bottom surface of said first panel, said second panel having an exterior edge extending between an upper surface and a lower surface of said second panel, a back side of said outer edge being hingedly coupled to a rear side of said exterior edge such that said bottom surface abuts said upper surface when said case is positioned in said closed position.

3. The assembly according to claim 2, wherein each of said grooves extending downwardly into said top surface, said grooves comprising a first set of grooves and a second set of grooves.

4. The assembly according to claim 3, wherein each of said first set of grooves extending between said back side and a front side of said outer edge, said first set of grooves being evenly spaced apart and distributed between a first lateral side of said outer edge and a middle of said first panel.

5. The assembly according to claim 4, wherein each of said second set of grooves having a first section and a second section extending forwardly from an associated one of each end of a rear section such that each of said second set of grooves has a U-shape, said second set of grooves extending between said middle and a second lateral side of said outer edge such that each of said first section and said second section extends between said back side and said front side, said second set of grooves being nested with respect to each other.

6. The assembly according to claim 5, wherein said wells extending downwardly into said top surface, said wells being evenly spaced apart and distributed between said rear section of an innermost one of said second set of grooves and said front side.

7. The assembly according to claim 6, further comprising each of said membranes being coextensively coupled to a bounding edge of an associated one of said wells, each of said membranes having a plurality of cuts radiating outwardly between a center of said membranes and said bounding edge and such that each of said membranes defines an iris.

8. The assembly according to claim 2, wherein each of said tracks being coupled to and extending downwardly from said lower surface, said tracks comprising a first set of said tracks and a second set of said tracks.

9. The assembly according to claim 8, wherein each of said first set of tracks having a respective first end and a respective second end, each of said first set of tracks being continuous and rounded at each of said first end and said second end such that each of said first set of tracks defines a cigar shape.

10. The assembly according to claim 9, further comprising each of said second set of tracks having a respective first section, a respective second section and a respective central section such that each of said second set of tracks defines a U-shape.

11. A craft storage assembly comprising:

a case being structured to be positionable in a closed position and an open position, said case comprising;

a first panel, said first panel having an outer edge extending between a top surface and a bottom surface of said first panel;

a second panel, said second panel having an exterior edge extending between an upper surface and a lower surface of said second panel, a back side of said outer edge being hingedly coupled to a rear side of said exterior edge such that said bottom surface abuts said upper surface when said case is positioned in said closed position;

said top surface of said first panel having a plurality of grooves extending downwardly therein wherein each of said grooves is configured to contain an object, said grooves comprising a first set of grooves and a second set of grooves;

each of said first set of grooves extending between said back side and a front side of said outer edge, said first set of grooves being evenly spaced apart and distributed between a first lateral side of said outer edge and a middle of said first panel;

each of said second set of grooves having a first section and a second section extending forwardly from an associated one of each end of a rear section such that each of said second set of grooves has a U-shape, said second set of grooves extending between said middle and a second lateral side of said outer edge such that each of said first section and said second section extends between said back side and said front side, said second set of grooves being nested with respect to each other;

said top surface of said first panel having a plurality of wells extending downwardly therein wherein each of said wells is configured to contain a plurality of objects, said wells being evenly spaced apart and distributed between said rear section of an innermost one of said second set of grooves and said front side;

a plurality of membranes each of said membranes being coextensively coupled to a bounding edge of an associated one of said wells such that each of said membranes completely covers said associated well, each of said membranes having a plurality of cuts radiating outwardly between a center of said membranes and said bounding edge and such that each of said membranes defines an iris wherein the objects are insertable and removable through each of said membranes; and a plurality of tracks, each of said tracks being coupled to and extending downwardly from said lower surface of said second panel, said tracks comprising a first set of said tracks and a second set of said tracks;

each of said first set of tracks having a respective first end and a respective second end, each of said first set of tracks being continuous and rounded at each of said first end and said second end such that each of said first set of tracks defines a cigar shape;

each of said second set of tracks having a respective first section, a respective second section and a respective central section such that each of said second set of tracks defines a U-shape; and each of said tracks being aligned with an associated one of said grooves when said case is in said closed position wherein each of said tracks is configured to retain the objects in said associated groove.

* * * * *